United States Patent [19]

Cameron

[11] Patent Number: 4,888,832

[45] Date of Patent: Dec. 26, 1989

[54] TOILET WITH MANUAL FLUSH

[75] Inventor: David B. Cameron, Milford, Mich.

[73] Assignee: Thetford Corporation, Ann Arbor, Mich.

[21] Appl. No.: 208,738

[22] Filed: Jun. 17, 1988

[51] Int. Cl.[4] ..... E03D 5/01

[52] U.S. Cl. ..... 4/321; 4/330; 74/99 A

[58] Field of Search ..... 4/315, 321, 323, 405, 4/407, 458, 322, 329, 330, 332; 128/205.14, 205.13; 417/472; 92/116, 140, 89, 90; 74/99 A, 89; 222/383, 385

[56] References Cited

U.S. PATENT DOCUMENTS

| | | | |
|---|---|---|---|
| 408,038 | 7/1889 | Moffat | 4/239 |
| 1,264,873 | 4/1918 | Scarborough | 4/323 |
| 2,428,451 | 10/1947 | Emerson | 128/205.13 |
| 2,766,753 | 10/1956 | Koch et al. | 128/205.14 |
| 2,986,098 | 5/1961 | Trout et al. | 92/90 |
| 3,066,853 | 12/1962 | Lanterberger | 92/90 |
| 3,191,814 | 6/1965 | Corsette et al. | 222/385 |
| 3,570,018 | 3/1971 | Sargent et al. | 4/323 |
| 3,747,130 | 7/1973 | Sargent et al. | 4/321 |
| 3,939,501 | 2/1976 | Sargent | 4/323 |
| 4,262,667 | 4/1981 | Grant | 128/205.14 |
| 4,510,629 | 4/1985 | Jovy et al. | 4/332 |

*Primary Examiner*—Henry J. Recla
*Assistant Examiner*—Edward C. Donovan
*Attorney, Agent, or Firm*—Harness, Dickey & Pierce

[57] ABSTRACT

A flush pump is disclosed for use in pumping water from a storage tank to a toilet bowl for flushing waste from the toilet such as in a recreational vehicle. The pump disclosed includes a housing with a bellows disposed therein with an inlet extending into the flush water storage tank and a discharge connected to the toilet bowl. A piston positioned above the bellows is used to depress the bellows upon rotation of the piston by an actuator above the piston. The actuator includes a cylindrical wall portion extending into the housing having a plurality of vertical flanges extending from the cylindrical side wall engaged with the piston side wall such that when the actuator is rotated the piston will rotate therewith. The housing side wall includes a fixed cam which is engaged with an incline flange cam follower extending from the piston side wall such that the piston will move downward upon rotation of the actuator. Each end of the inclinded flange includes a stop to limit the rotation of the piston and actuator. Upon release of the actuator, the compressive forces within the bellows will raise the piston to its original position.

10 Claims, 4 Drawing Sheets

TOILET WITH MANUAL FLUSH

BACKGROUND OF THE INVENTION

This invention relates to a manual flush pump for a toilet and more particularly, to a manual flush pump for a stationary toilet installed in a recreational vehicle.

Many recreational vehicles include a bathroom area having a sanitary toilet fixture. Generally associated with the toilet fixture is a storage tank for holding flush water to use in flushing the toilet. A pump is needed to pump the water from the storage tank to the toilet bowl for flushing the waste from the toilet. One such device is a bellows pump as described in U.S. Pat. No. 4,180,876, issued Jan. 1, 1980 and commonly assigned. Operation of the bellows pump requires the operator to push down on the bellows one or more times to flush the toilet. The volume of flush water delivered from a bellows pump is dependent upon how far the bellows is depressed. This variability in the volume of flush water used to flush the toilet affects the amount of water needed per flush and can result in excessive water usage necessitating more frequent disposal of waste and refilling of the flush water tank.

Accordingly, it is an object of this invention to provide a manually operated flush pump which reduces the variability of the volume of flush water used.

It is an advantage of this invention that a bellows is depressed by applying rotary motion to a flush actuator as opposed to directly depressing the bellows.

It is another feature of this invention to provide a positive stop to control the amount of depression of the bellows.

It is an advantage of this invention that the flush is actuated by a rotational motion which is more familiar to most people to flush toilets then depression of a bellows.

SUMMARY OF THE INVENTION

The present invention provides a manually actuated toilet flush pump which uses rotational motion of an actuator to compress a bellows pump for flushing the toilet bowl. One design of a stationary toilet for a recreational vehicle is disclosed in U.S. patent application Ser. No. 870,800, filed June 5, 1986, commonly assigned, in which the toilet bowl is contained within a bench structure in the bathroom area of the reactional vehicle. Surrounding the bowl is a flush water storage tank. Below the toilet bowl is a holding tank in fluid connection with the toilet bowl outlet for receiving and holding waste and flush water from the toilet bowl. The flush pump of the present invention is located in the storage tank with the actuator adjacent the toilet, above the bench structure. The flush pump includes a housing extending below the bench into the storage tank having a bellows within the housing and connected to an inlet from the storage tank and a discharge to the toilet bowl.

A piston is provided between the actuator and the bellows and interconnected with the actuator such that the piston will rotate with the rotation of the actuator. The interconnection between the piston and actuator allows for translational motion of the piston relative to the actuator during rotation of the piston. The translation of the piston is provided for by a fixed cam extending from the inner side of the housing and an inclined cam follower extending from the outer side of the piston side wall. When the actuator is rotated, the piston rotates with it and the cam forces the piston downward to depress the bellows forcing water through the discharge tube to the toilet bowl. Upon release of the actuator, the internal spring force of the bellows forces the piston upward, thereby rotating the piston and actuator to the initial position. As the bellows expands, the decreased pressure within the bellows draws water from the storage tank through the inlet conduit into the bellows.

The cam follower includes stops to limit the rotation of the actuator and piston. A check valve in the water inlet to the bellows prevents water from flowing back into the storage tank when the bellows is depressed and a check valve in the water discharge prevents air from being drawn into the bellows as the bellows expands.

Further objects, features and advantages of the invention will become apparent from a consideration of the following description and the appended claims when taken in connection with the accompanying drawing.

DETAILED DESCRIPTION OF THE DRAWING

Figure 1:
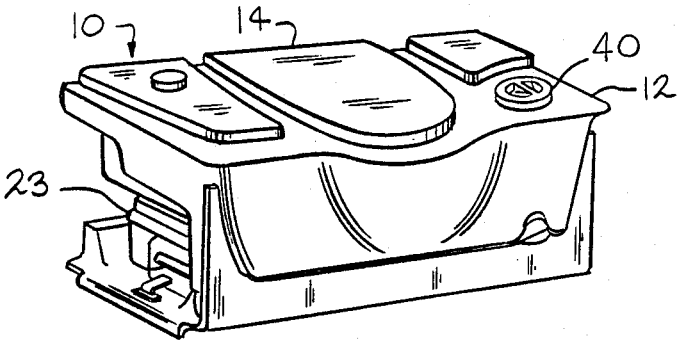
FIG. 1 is a perspective view of a stationary toilet in a recreational vehicle having a flush pump according to this invention.
Figure 2:
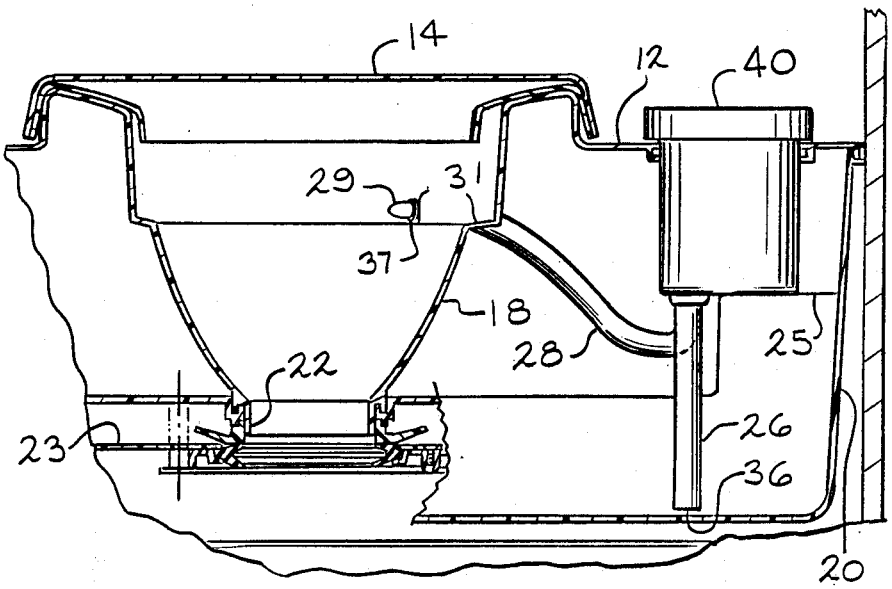
FIG. 2 is a sectional view of a portion of the toilet of FIG. 1 showing the flush pump in position beside the toilet bowl.

A representative toilet for use in a recreational vehicle is shown generally at 10 in FIG. 1. The toilet includes a bench structure 12 having a toilet cover 14 on the top. Cover 14 can be raised to expose a toilet seat and toilet bowl which extends downward into the bench 12. Toilet bowl 18, as seen in FIG. 2, is surrounded by a flush water storage tank 20 contained within the bench 12. Tank 20 is used to store water for use in flushing the bowl. Located beneath the bowl and in fluid connection with the toilet bowl outlet 22 is a waste holding tank 23. The holding tank is used for holding flush water and waste and is removable from the recreational vehicle for disposal of the waste. This type of toilet is fully described in U.S. patent application Ser. No. 870,800 now U.S. Pat. No. 4,776,631 issued Oct. 1, 1988, filed June 5, 1986, commonly assigned.

Disposed within the flush water storage tank 20 is a manually operated flush pump 24 which is fixed to shelf 25 within tank 20. Pump 24 has a flush water inlet 26 which extends below the pump, and preferably, to the lowermost point of storage tank 20. Pump 24 also has a discharge conduit 28 which delivers the flush water from the pump 24 to nozzle 29 in bowl 18 for flushing waste from the bowl.

Figure 3:
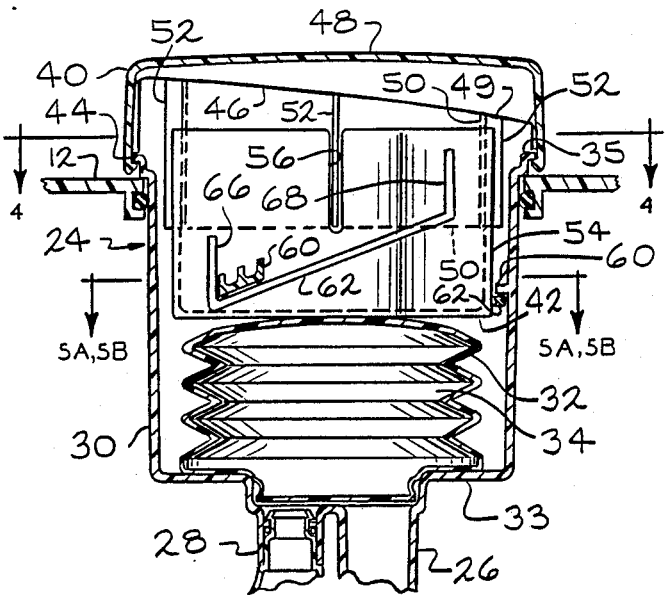
FIG. 3 is a partial sectional view of the flush pump showing the interior construction of the pump with the bellows in an expanded position.

Referring now to FIG. 3, the inner construction of the pump 24 is illustrated. The pump 24 includes a housing 30 having a lower end 33 and an open upper end at 35. Disposed within housing 30 is a bellows 32 which defines a pump chamber 34 within the bellows 32. Pump chamber 34 is in fluid communication with the inlet conduit 26 to receive flush water from storage tank 20. Pump chamber 34 is also in communication with discharge conduit 28 for discharge of the flush water to the toilet bowl 18. When bellows 32 is compressed, flush water within the pump chamber is forced out through conduit 28 to the toilet bowl through nozzle 29. The water flows from nozzle 29 tangentially onto shelf 31 and thence in a swirling path onto the bowl so as to dislodge waste therein and flush it into discharge opening 22. When bellows 32 expands, water will be drawn from the storage tank 20 into the pump chamber. A check valve 36 at the lower end of inlet conduit 26 prevents the flush water from returning to the storage tank when the bellows is depressed. Likewise, a check valve 37 in nozzle 29 prevents air from being drawn into conduit 28 and the bellows during expansion of the bellows.

The bellows is depressed by an actuator means which includes a manually operated actuator 40 and a piston 42. Upon rotation of the actuator 40, the piston 42 moves downward to depress bellows 32 forcing flush water from the pump chamber to the bowl 18. Upon release of the actuator 40, the spring forces within bellows 32 force the piston upward to the expanded position of bellows 32. Actuator 40 is located above the top surface of bench 12 and is snapped over annular lip 44 at the top edge of housing 30.

Actuator 40 includes a circular disc portion 46 which is contoured with two diametrically opposed recessed portions 49 to form a generally rectangular diametrically extending grip 48. Grip 48 is used to facilitate manual grasping of actuator 40 with thumb and forefinger for rotation of the actuator in one direction to flush the toilet. Projecting downward from the disc portion 46 into to the housing 30 is a cylindrical wall 50. Extending radially outward from cylindrical wall 50 are three vertical flanges 52 which engage with the side wall 54 of piston 42. Piston side wall 54 contains three vertical slots 56 for reception of flanges 52, providing engagement of actuator 40 with piston 42 such that the piston will rotate with rotation of the actuator 40.

Figure 4:
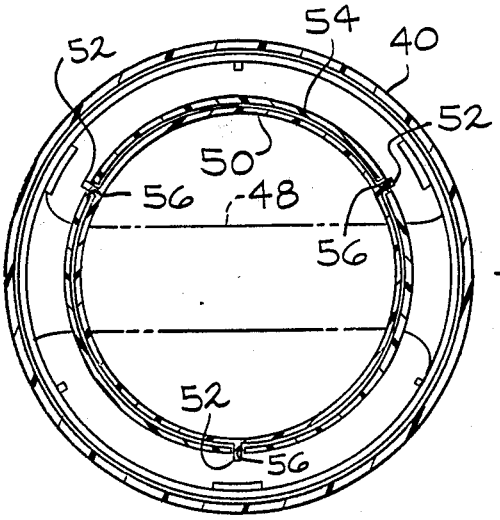
FIG. 4 is a sectional view of the flush pump as seen substantially along line 4—4 of FIG. 3 with the actuator grip in broken lines to show the orientation of the grip relative to internal components.

FIG. 4 shows the relationship between the cylindrical wall 50 and piston side wall 54 and the engagement of flanges 52 with slots 56 in side wall 54 of piston 42.

Referring back to FIG. 3, projecting inward from the housing 30 are three fixed cams 60, only one of which is shown in FIG. 3. Cams 60 are used to provide the downward motion of piston 42 when the piston is rotated. Piston side wall 54 includes outwardly projecting inclined cam followers 62 which engage with the fixed cams 60. Cam followers 62 are positioned below cams 60 such that when the piston 42 is rotated clockwise as viewed from the top, the cams will force the piston downward to compress bellows 32. The ends of followers 62 include vertical stop flanges 66 and 68 extending upward from followers 62. Stops 66 and 68 limit the rotation of piston 42.

Figure 5A:
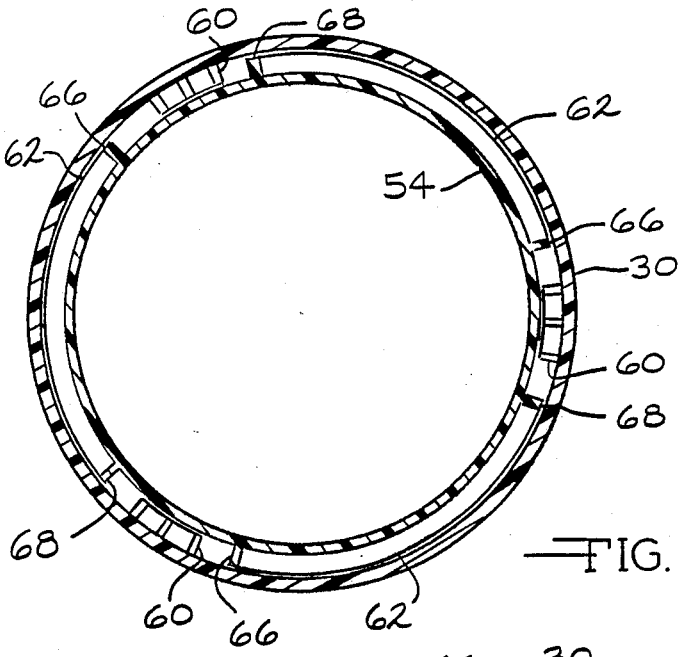
FIG. 5A is a sectional view of the flush pump as seen substantially along line 5A—5A of FIG. 1 during assembly of the pump.
Figure 5B:
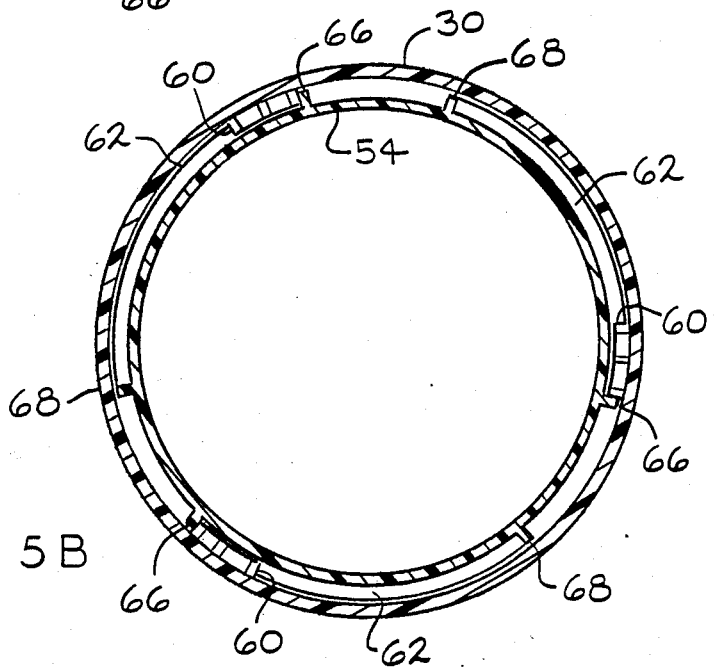
FIG. 5B is a sectional view of the flush pump as seen substantially along line 5B—5B of FIG. 1 with the bellows fully expanded.

The piston 42 is assembled into the housing 30 by depressing the bellows 32 and inserting the piston 42 in the position shown in FIG. 5A. In this position, the piston is moved downward into housing 30 with the cam followers 62 positioned between cams 60. Once the top end of stops 66 are below cams 60, the piston is rotated until cam followers 62 are below cams 60. The piston is then released, allowing bellows 32 to push piston 42 upward to the position shown in FIGS. 3 and 5B.

Figure 6:
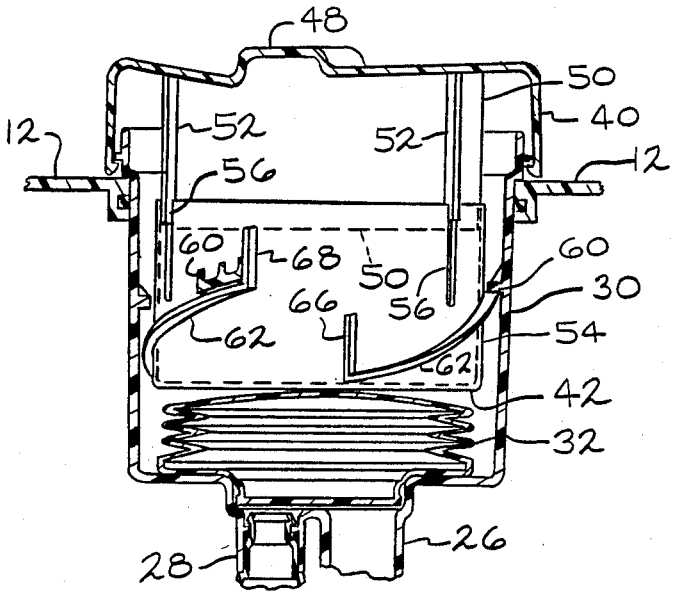
FIG. 6 is a partial sectional view of the flush pump as shown in FIG. 3 with the bellows fully depressed.

FIG. 6 shows the actuator 40 in a rotated position with the piston 42 depressing bellows 32. Cam followers 62 are rotated such that cams 60 are in contact with stops 68.

In operation of the flush pump, the actuator 40 is rotated clockwise, thereby rotating piston 42 clockwise. As the piston rotates, it is urged downward by cams 60 and followers 62, thereby compressing the bellows 32, urging water in the bellows to be discharged through conduit 28 to the toilet bowl 18. Upon release of the actuator 40, the compressive forces within bellows 32 will force the piston upward causing the piston and actuator to rotate counterclockwise to the original position. As bellows 32 expands, the pressure decrease within the pump chamber 34 will draw water through check valve 36 and conduit 26, into pump chamber 34.

The flush pump as described provides an easier means for actuating a bellows pump to flush the toilet. The stops at the cam follower ends provide a convenient way to regulate the amount of flush water delivered to the toilet. In addition, the rotational motion used to actuate the flush is more familiar to most users then direct pushing against a bellows pump.

It is to be understood that the invention is not limited to the exact construction or method illustrated and described above, but that various changes and modifications may be made without departing from the spirit and scope of the invention as defined in the following claims.

What is claimed is:

1. In a toilet having a bowl and a flush water storage tank, a pump comprising:

a housing;

a bellows disposed within said housing defining a pump chamber having an inlet in communication with said storage tank and an outlet in communication with said bowl, said bellows being compressible in a predetermined direction to evacuate said pump chamber; and actuator means engaging said bellows and operable for compressing said bellows, said actuator means being rotatable about an axis parallel to the direction of compression of said bellows and movable in translation in the direction of compression of said bellows upon rotation of said actuator means so as to compress said bellows.

2. The toilet of claim 1 wherein said actuator means comprises:

an actuator member rotatable about said axis;

a piston disposed within said housing, said piston operatively engaging said actuator member for rotation of said piston in response to rotation of said actuator member; and means operatively associated with said piston and said housing for providing translation of said piston in a direction parallel to said axis in response to rotation of said piston by said actuator member, said piston engaging said bellows and being operable to compress said bellows upon translation of said piston.

3. The toilet of claim 2 further comprising engagable stop means on said piston and said housing to limit rotation of said actuator member and said piston.

4. The toilet of claim 2 wherein said means for providing translation of said piston includes a cam integrally formed with one of said piston and said housing and a cam follower integrally formed with the other of said piston and said housing, said cam follower engaging said cam for sliding motion relative to said cam.

5. In a toilet having a bowl and a flush water storage tank, a pump comprising:

a housing fixed within said storage tank having a lower end portion and an open upper end;

a bellows disposed upright within said housing upon said lower end portion defining a pump chamber having an inlet in communication with said tank and an outlet in communication with said bowl;

an actuator member rotatably mounted to said upper end of said housing and rotatable about an axis, said actuator member having a wall portion extending downward into said housing;

a piston disposed within said housing between said actuator member and said bellows, said piston rotatable about said axis and movable in translation parallel said axis, said piston having a side wall portion;

cooperating drive means on said actuator member wall portion and said piston side wall portion operable to provide rotation of said piston upon rotation of said actuator member; and coacting means on said piston side wall portion and said housing operable to provide translation of said piston upon rotation of said piston.

6. The toilet of claim 5 wherein said cooperating drive means comprises flanges extending radially from said actuator member wall portion engagable in slots in said piston side wall portion.

7. The toilet of claim 5 wherein said coacting means comprises a fixed cam extending inwardly from said housing and an inclined flange extending outwardly from said piston side wall portion engaged with said cam.

8. The toilet of claim 7 further comprising a vertical flange projecting outward from said piston side wall at each end of said inclined flange to limit rotation of said piston.

9. The pump of claim 6 further comprising:

a check valve in said inlet to prevent flow of water from said pump chamber into said tank; and a check valve in said outlet to prevent the flow of air into said outlet and said bellows.

10. In a toilet having a bowl and a flush water storage tank, a pump comprising:

a housing fixed within said storage tank having a lower end portion and an open upper end;

a bellows disposed upright within said housing upon said lower end portion defining a pump chamber having an inlet in communication with said tank and an outlet in communication with said bowl;

an actuator member rotatably mounted to said upper end of said housing and rotatable about an axis, said actuator member having a wall portion extending downward into said housing, said wall portion having flanges extending radially therefrom;

a piston disposed within said housing between said actuator member and said bellows, said piston rotatable about said axis and movable in translation parallel said axis, said piston having a side wall portion defining slots engagable with said flanges extending radially from said wall portion to rotate said piston upon rotation of said actuator member;

a fixed cam extending inwardly from said housing;

an inclined flange extending outwardly from said piston side wall portion engaged with said cam to provide downward translation of said piston upon rotation thereof; and a vertical flange projecting outward from said piston side wall at each end of said inclined flange to limit rotation of said piston.

* * * * *